US007086127B1

(12) United States Patent
Reidy

(10) Patent No.: US 7,086,127 B1
(45) Date of Patent: Aug. 8, 2006

(54) MONEY CLIP SHAPED LIKE A FISHING REEL

(76) Inventor: James T. Reidy, 14431 Ventura Blvd., P.O. Box 117, Sherman Oaks, CA (US) 91423

( * ) Notice: Subject to any disclaimer, the term of this patent is extended or adjusted under 35 U.S.C. 154(b) by 113 days.

(21) Appl. No.: 10/974,100

(22) Filed: Oct. 26, 2004

(51) Int. Cl.
*B42F 1/00* (2006.01)

(52) U.S. Cl. ..... 24/531; D11/78.1; 24/67.3; 24/67 R

(58) Field of Classification Search ..... 24/531, 24/67.3, 67 R, 1; 242/405, 405.2, 405.3; D11/78.1
See application file for complete search history.

(56) References Cited

U.S. PATENT DOCUMENTS

| | | | | |
|---|---|---|---|---|
| 4,447,950 | A * | 5/1984 | Mizelle | 30/155 |
| 5,305,999 | A * | 4/1994 | Tate | 224/269 |
| 5,873,166 | A * | 2/1999 | Page | 30/113 |
| D505,635 | S * | 5/2005 | McGee | D11/78.1 |
| 7,000,291 | B1 * | 2/2006 | Fuller | 24/301 |

* cited by examiner

*Primary Examiner*—Robert J. Sandy
(74) *Attorney, Agent, or Firm*—Jack C. Munro

(57) ABSTRACT

A money clip that is constructed to resemble a fishing reel with the money clip including a rotatable plate on which is mounted a handle. Manual rotation of the handle and the plate produces a movement that resembles the fishing line winding movement of a conventional fishing reel.

8 Claims, 2 Drawing Sheets

MONEY CLIP SHAPED LIKE A FISHING REEL

BACKGROUND OF THE INVENTION

1. Field of the Invention

The field of this invention relates to a money clip and more particularly to an ornamental shaped money clip that essentially resembles a fishing reel.

2. Description of the Related Art

Money clips have long been known. The general purpose of a money lip is to secure together a stack of monetary paper bills. The money clip and the bills are then carried in ones pocket. When an individual wishes to spend some of the money, the individual is remove the money clip from the pocket and remove the stack of bills from the money clip and remove what bills the individual wishes to spend and then fold the remaining bills together and insert such back into the money clip.

In the past, money clips have been designed in numerous different configurations. An exceedingly common sporting activity is fishing. Previous to the present invention, it has not been known to design a money clip to resemble a fishing article and specifically a fishing reel.

SUMMARY OF THE INVENTION

A basic embodiment of fishing reel money clip that has a base with there being a first disc and a second disc fixed to the base. The second disc is located in juxtaposition with the first disc forming a gap area therebetween. The first disc is capable of deflecting movement relative to the second disc to widen the gap area permitting insertion of folded paper money between the first disc and the second disc. A plate is journaled on the first disc with the plate being rotatable thereon, the plate being configured to resemble a side of a fishing reel.

A further embodiment of the present invention is where the basic embodiment is modified by including of a biasing spring within the confines of the gap area with this biasing spring to exert a bias against the folded money that is mounted therein to retain same within the money clip.

A further embodiment of the present invention is where the basic embodiment is modified by there being formed on the plate a handle with this handle being movable between a retracted position and an extended position.

A further embodiment of the present invention is where the just previous embodiment is modified by the handle being movable ninety degrees.

A further embodiment of the present invention is where the just previous embodiment is modified by the handle being mounted on a deflectable spring with this deflectable spring functioning to exert a bias tending to retain the handle in the retracted position when in the retracted position and also retain the handle in the extended position when in the extended position.

A further embodiment of the present invention is where the basic embodiment is modified by there being included within the first disc a ratchet mechanism with this ratchet mechanism to produce a clicking sound during rotation of the plate within the first disc.

A further embodiment of the present invention is where the just previous embodiment is modified by the ratchet mechanism being defined as comprising a toothed ring fixed to the first disc and a toothed periphery on the plate. The toothed periphery is located concentric to the toothed ring. A ring shaped wire is mounted between the toothed periphery and the toothed ring. The ring shaped wire is in contact with both the toothed ring and the toothed periphery.

BRIEF DESCRIPTION OF THE DRAWINGS

For a better understanding of the present invention, reference is to be made to the accompanying drawings. It is to be understood that the present invention is not limited to the precise arrangement shown in the drawings.

DETAILED DESCRIPTION OF THE INVENTION

Figure 1:
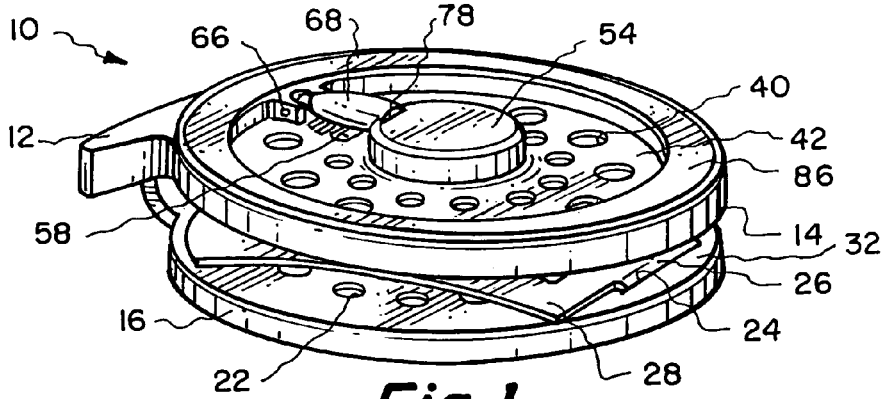
FIG. 1 is a perspective view of the money clip constructed in accordance with this invention.

Referring particularly to the drawings, there is shown the money clip 10 of the present invention. The money clip 10 has a base 12 which is formed to resemble an elongated bar that is used within a conventional fishing reel to mount the fishing reel onto a fishing pole. Integrally mounted on the base 12 is a first disc 14 and a second disc 16. The first disc 14 is located in juxtaposition to the second disc 16 but spaced therefrom forming a gap area 18. The second disc 16 has an exterior configuration that includes a hub 20 with a series of holes 22 located around the hub 20. It is the function of the hub 20 and the holes 22 to resemble a side of a conventional fly fishing reel as such are normally constructed in this manner. Also included within the second disc 16 is a rectangularly shaped hole 24.

Within the rectangularly shaped hole 24 is to be mounted a U-shaped end 26 of a biasing spring 28. The biasing spring 28 is formed in the shape of a ring having an enlarged center opening 30. The biasing spring 28 is to abut against both the second disc 16 and the first disc 14. Folded paper money is to be insertable through the front end 32 of the gap area 18 causing the first disc 14 to deflect relative to the second disc 16 with the paper folded money to be captured and held between the biasing spring 28 and the first disc 14. The first disc 14 includes a circular shaped chamber 34. The wall surface of the chamber 34 includes a continuous series of teeth 38.

Reproduced within a plate 42 is a series of holes 40 that are essentially identical to the pattern of the holes 22. The plate 42 is to be mountable within the chamber 34. The periphery of the plate 42 includes an annular series of teeth 44. The teeth 44 are to be in alignment but spaced from the teeth 38.

The plate 42 has a centrally located collar 46. Internally of the collar 46 is a through opening 48. Mounted within the through opening 48 is a shaft 50 with the shaft 50 including an annular groove 52. The shaft 50 is integrally connected onto a button 54. The shaft 50 is to be forcibly inserted within the through opening 48 with an interlocking arrangement being obtained between the collar 46 and the groove 52 to securely retain the button 54 relative to the plate 42.

Figure 2:
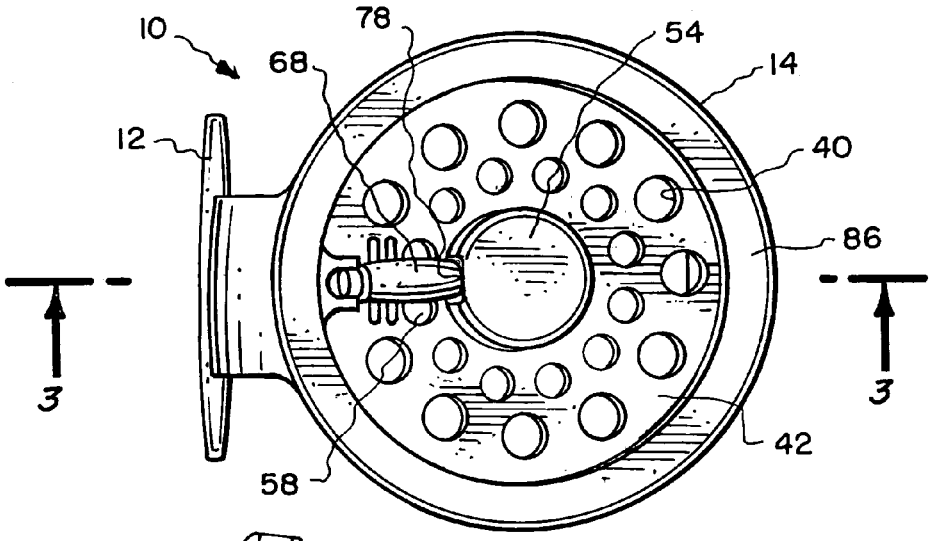
FIG. 2 is a side view of the money clip of the present invention clearly showing the movable plate in conjunction with the first disc of the money clip.
Figure 3:
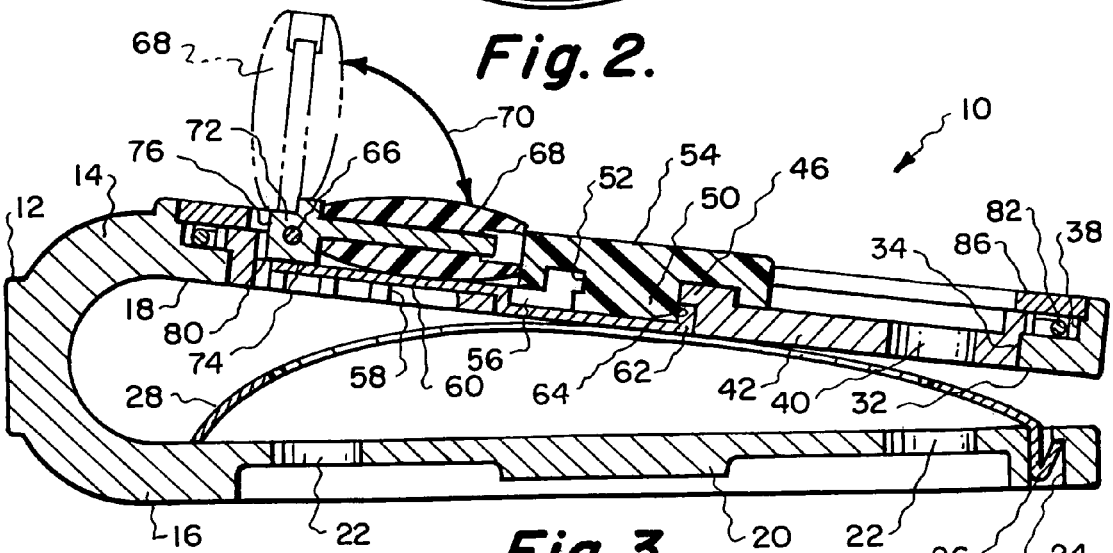
FIG. 3 is a longitudinal cross-sectional view through the money clip of the present invention taken along line 3—3 of FIG. 2.
Figure 4:
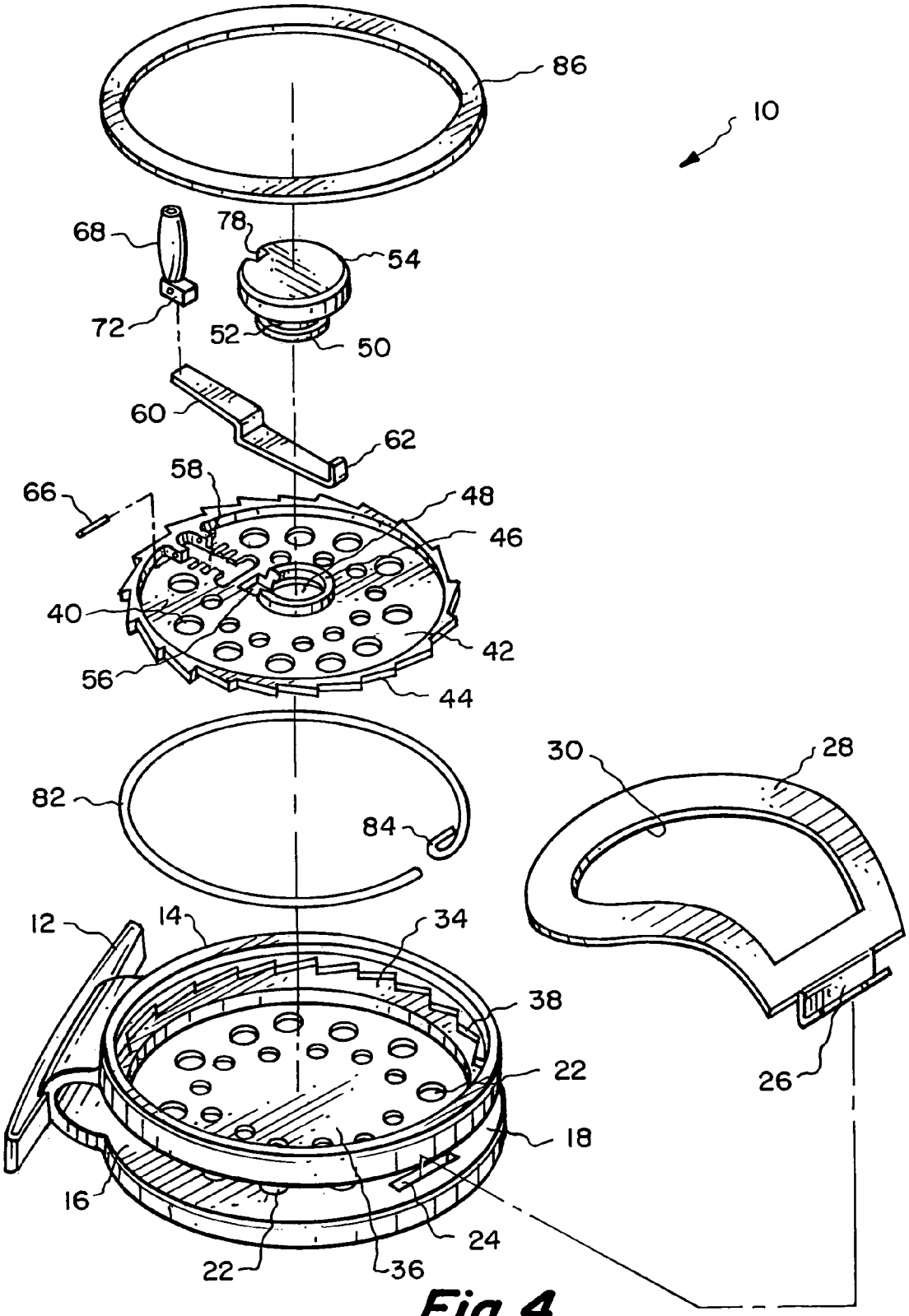
FIG. 4 is an exploded isometric view of the money clip of the present invention.

The plate 42 includes a small opening 56 and a large opening 58. An elongated member 60, which has an upturned end 62, is to be inserted through the small opening 56 and then turned about forty-five degrees so that the portion of the elongated member 60 that is located furthest from the upturned end 62 is to be in substantial alignment with the general plane of the first disc 14. The upturned end 62 engages within a notch 64 which is formed in the undersurface of the plate 42. It is the notch 64 that establishes the position of the elongated member 60. The elongated member 60 will function as a deflecting spring which is to be described as follows: Pivotally mounted by a pivot pin 66 to the plate 42 is a handle 68. The handle 68 is pivotable from a retracted position shown in FIGS. 1–3 to an extended position shown in phantom lines in FIG. 3. Movement of the handle 68 from the retracted position to the extended position comprises about ninety degrees in movement, as is depicted by arrow 70. The base section 72 of the handle 68 continuously abuts against the elongated member 60. The base section 72 includes a planar surface 74 and a planar surface 76. With the planar surface 74 in contact with the elongated member 60, the handle 68 is in the retracted position with the forward end of the handle 68 being located within a notch 78 formed in button 54. With the surface 76 in contact with the elongated member 60, the handle 68 is in the extended position, depicted in phantom lines in FIG. 3. During movement of the handle 68 between the retracted position and the extended position, the elongated member 60 will deflect as the elongated member 60 rides over corner 80 of the base section 72. Therefore, the elongated member 60 functions as a deflecting spring. The deflecting spring also functions to hold the handle 68 in the retracted position and, when in the retracted position, it also functions to hold the handle 68 in the extended position when in the extended position. However, the handle 68 can easily be manually moved between the retracted position and the extended position.

The user of the money clip 10 of this invention can readily move the handle 68 from the retracted position to the extended position and by grasping onto such cause rotational movement of the plate 42 relative to the first disc 14. Located between the teeth 44 and the teeth 38 is a wire ring 82 which has an enlarged end 84. As the plate 42 is rotated, the enlarged end 84 produces a clicking sound duplicating the ratcheting motion of a conventional fishing reel. Also, the handle 68 resembles the handle of a conventional fishing reel.

It is therefore to be understood that the money clip 10 of this invention constitutes a novelty type item that is believed to be attractive to fisherman.

In order to seal the chamber 34, there is inserted a ring-shaped cover 86 within the outermost portion of the chamber 34 which will retain in position the wire ring 82 and will also keep in position the plate 42 within the chamber 34.

The discussion included in this patent is intended to serve as a basic description. The reader should be aware that the specific discussion may not explicitly describe all embodiments possible and alternatives are implicit. Also, this discussion may not fully explain the generic nature of the invention and may not explicitly show how each feature or element can actually be representative of a broader function or of a great variety of alternative or equivalent elements. Again, these are implicitly included in this disclosure. Where the invention is described in device-oriented terminology, each element of the device implicitly performs a function. It should also be understood that a variety of changes may be made without departing from the essence of the invention. Such changes are also implicitly included in the description. These changes still fall within the scope of this invention.

Further, each of the various elements of the invention and claims may also be achieved in a variety of manners. This disclosure should be understood to encompass each such variation. Particularly, it should be understood that as the disclosure relates to elements of the invention, the words for each element may be expressed by equivalent apparatus terms, even if only the function or result is the same. Such equivalent, broader, or even more generic terms should be considered to be encompassed in the description of each element or action. Such terms can be substituted where desired to make explicit the implicitly broad coverage to which this invention is entitled. It should be understood that all actions may be expressed as a means for taking that action or as an element which causes that action. Similarly, each physical element disclosed should be understood to encompass a disclosure of the action which that physical element facilitates. Such changes and alternative terms are to be understood to be explicitly included in the description.

What is claimed is:

1. A fishing reel money clip comprising:

a base;

a first disc fixed to said base;

a second disc fixed to said base with said second disc being located in juxtaposition with said first disc forming a gap area there between, said first disc being capable of deflecting movement relative to said second disc to widen said gap area permitting insertion of folded paper money between said first disc and said second disc; and a plate journaled on said first disc, said plate being rotatable on said first disc, said plate having a center through opening, a shaft mounted within said through opening, said plate being configured to resemble a side of a fishing reel.

2. The fishing reel money clip as defined in claim 1 wherein:

said first disc including a ratchet mechanism, said ratchet mechanism producing a repeating click during rotation of said first disc.

3. The fishing reel money clip as defined in claim 2 wherein:

said ratchet mechanism comprising a toothed ring fixed to said first disc and a toothed periphery mounted on said plate, said toothed periphery located concentric to said toothed ring, a ring shaped wire mounted between said toothed periphery and said toothed ring, said ring shaped wire being in contact with both said toothed ring and said toothed periphery.

4. The fishing reel money clip as defined in claim 1 wherein:

said shaft being interlockingly mounted to said plate.

5. The fishing reel money clip as defined in claim 4 wherein:

a button, said button being fixed to said shaft, said button protruding outwardly from said plate.

6. A fishing reel money clip comprising:

a base;

a first disc fixed to said base;

a second disc fixed to said base with said second disc being located in juxtaposition with said first disc forming a gap area there between, said first disc being capable of deflecting movement relative to said second disc to widen said gap area permitting insertion of folded paper money between said first disc and said second disc;

a plate journaled on said first disc, said plate being rotatable on said first disc, said plate being configured to resemble a side of a fishing reel;

a handle mounted on said first disc, said handle being movable between a retracted position and an extended position.

7. The fishing reel money clip as defined in claim 6 wherein:

movement of said handle between said retracted position and said extended position being ninety degrees.

8. The fishing reel money clip as defined in claim 7 wherein:

said handle abutting against a deflectable spring, said deflectable spring deflecting during movement of said handle between said retracted position and said extended position, said deflectable spring functioning to exert a bias tending to maintain said handle when in either said retracted position or said extended position.

* * * * *